United States Patent [19]

Björkman et al.

[11] 4,216,406

[45] Aug. 5, 1980

[54] ELECTRIC LAMP WHEREIN THE TERMINAL SOCKET CAP CONTAINS A FOAMED CAP CEMENT WHICH FUNCTIONS TO PREVENT EXPLOSIONS AND/OR BURNING A HOLE THROUGH THE CAP

[75] Inventors: Karl Å. G. Björkman; Günther Jönsson, both of Karlskrona, Sweden

[73] Assignee: Lumalampan Aktiebolag, Stockholm, Sweden

[21] Appl. No.: 940,583

[22] Filed: Sep. 8, 1978

Related U.S. Application Data

[62] Division of Ser. No. 772,596, Feb. 28, 1977, abandoned.

[30] Foreign Application Priority Data

Feb. 27, 1976 [SE] Sweden ..... 7602609

[51] Int. Cl.[2] ..... H01K 1/20

[52] U.S. Cl. ..... 313/315; 174/137 B; 200/144 C; 252/63.2; 252/63.5; 252/66; 313/318; 339/144 R

[58] Field of Search ..... 200/144 C, 151; 174/137 B, DIG. 1; 252/63.2, 63.5, 66; 313/315, 318; 339/144 R

[56] References Cited

U.S. PATENT DOCUMENTS

| | | | |
|---|---|---|---|
| 2,531,007 | 11/1950 | Strom et al. | 200/144 C |
| 2,733,419 | 1/1956 | Beck | 339/144 R |
| 3,047,765 | 7/1962 | Vichill | 339/144 R X |
| 3,213,254 | 10/1965 | Strom | 174/DIG. 1 |
| 3,242,257 | 3/1966 | Jones et al. | 252/63.2 X |
| 3,253,179 | 5/1966 | Edwards et al. | 313/318 |
| 3,458,747 | 7/1969 | Gainer et al. | 313/318 |
| 3,475,546 | 10/1969 | Sadler | 252/63.5 X |
| 3,582,586 | 6/1971 | Jones | 174/137 B X |
| 3,864,598 | 2/1975 | Caddwell | 313/315 X |

FOREIGN PATENT DOCUMENTS

| | | |
|---|---|---|
| 701332 | 1/1941 | Fed. Rep. of Germany. |
| 75349 | 8/1970 | Fed. Rep. of Germany. |
| 944447 | 6/1965 | United Kingdom. |
| 1303869 | 1/1973 | United Kingdom. |
| 1088056 | 10/1974 | United Kingdom. |

*Primary Examiner*—Leland A. Sebastian

*Attorney, Agent, or Firm*—Frishauf, Holtz, Goodman & Woodward

[57] ABSTRACT

An improved electric lamp of the type wherein a transparent bulb is sealed to a terminal socket cap and contains a foamed cap cement which substantially fills the interior of said terminal cap. The foamed cap cement contains a small amount of a halogen-containing material and functions to extinguish electric arcs generated in the cap.

11 Claims, 1 Drawing Figure

Figure 1:
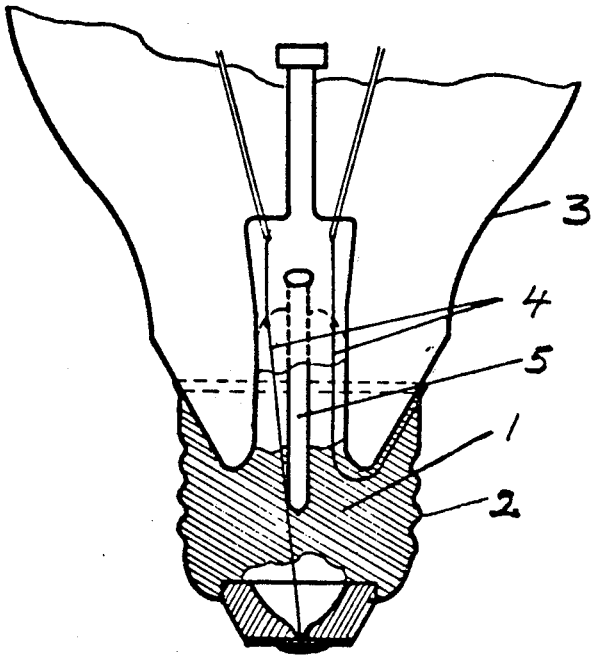

ELECTRIC LAMP WHEREIN THE TERMINAL SOCKET CAP CONTAINS A FOAMED CAP CEMENT WHICH FUNCTIONS TO PREVENT EXPLOSIONS AND/OR BURNING A HOLE THROUGH THE CAP

This is a division of application Ser. No. 772,596, filed Feb. 28, 1977, now abandoned.

Ever since the start of manufacturing of gas-filled bulbs, especially those equipped with a coiled-coil tungsten filament, one has had to take into consideration and try to eliminate the risk of electric flash-over causing the formation of electric arcs in the cap of the electric lamp bulb. In order to neutralize this unfavourable phenomenon a number of measures, separately or combined with each other, have been taken. For example fuses inside the cap of the lamp have been used, but by doing so it is of extreme importance that an electric arc, generated at the release of the safety fuse, will be quickly extinguished.

This so called secondary electric arc effect, sometimes generated in the cap is still troublesome. Such a secondary electric arc arises as a consequence of the explosive burning-out of the fuse, and can in many cases melt a hole in the cap, which in turn can lead to welding-together and a possible risk of fire for the immediate surrounding. Besides, in exceptional cases the generated electric arc can cause an increase of pressure in the closed cap space that is strong enough to powerfully throw the bulb away from the cap with the risk of personal injuries.

Known examples of measures taken to handle the above-mentioned problems are:

(a) Addition of certain percentages of nitrogen gas to the filling gas in order to suppress the forming of a primary electric arc inside the bulb space itself.

(b) Introduction of thin fuse wires in the lamp cap, often combined with an internally glass insulated cap, in order to prevent the secondary electric arc from burning a hole in the cap.

(c) Introduction of thin fuse wires, sealed in glass tubes with or without glass powder filling, through which a better extinction of the secondary electric arc is achieved as long as the glass tubes can resist the thermal shock during the burning-off of the fuse wires.

(d) Introduction of thin fuse wires combined with insulating foam mass filling the cap space, which is supposed to prevent an electric arc from burning a hole in the cap.

(e) Introduction of thin fuse wires combined with thermofoaming cap cement filling the cap space, which thereby on one hand attaches the cap to the bulb, and on the other is supposed to prevent the electric arc from burning a hole in the cap.

The present invention concerns an electric bulb equipped with a cap, the cap being filled with a thermofoaming cement with such properties that (i) the cap can be attached to the bulb. (ii) the cap space almost completely can be filled and (iii) the electric arc generated in the cap space can be quickly extinguished by special measures.

The invention is based upon the fact that the ability of the porous insulating cement mass to extinguish a generated electric arc in the cap space is uniquely improved by the addition of halogen compounds, preferably metal halides and among these especially metal fluorides, to the cement, which mainly consists of a thermosetting phenolic resin, expanding agent and stone powder. Surprisingly enough the added halogen compound does not have to be inorganic. Even for instance teflon powder has proved to give excellent results.

From this addition it has turned out to be possible to completely eliminate the risk of exploding lamps because of an increase of pressure in the cap.

It is believed that if electrons in an electric field can be absorbed before they attain enough energy to decompose the molecule, the forming of additional current carrying ions, which give rise to and maintain an electric arc, will be strongly reduced. An electronegative gas, which is created through the heating of halogen compounds, easily absorbs electrons and generates negative ions with a low velocity, which, according to the concept of the invention, reduce the positive space charge around the fused wire. Alternatively this reaction can occur in the solid state through interaction between the halogen compound and the macrostructure of the cement.

Thus the halogen addition works as a unique electric arc-extinguishing added ingredient to the cement, in which the fuse wire is embedded.

FIG. 1 is a cross-sectional view of the cap end portion of a lamp.

The invention is described in greater detail with reference to FIG. 1 and in a report of results from practical experiments with electric bulbs. The reference and experiment bulbs that have been produced have all been manufactured under equivalent circumstances in such a way that the probability of flashover in the bulbs and generation of an electric arc in the cap is greater than for bulbs produced in the normal way.

To a known cap cement of the combination type (i.e. attaches the glass bulb and fills out the cap space) (1) is added a few percent of a suitable halogen compound, for instance calcium fluoride, lead iodide, barium chloride or Teflon powder. The cap cement produced in this way is dosed in a suitable quantity into a normal uninsulated cap (2). The bulb (3) and the cap (2) are heated jointly whereby the cap cement foams and attaches to the bulb and the cap and also fills out the space in the cap. The quantity of the cement is balanced in such a way that after the curing of the cement the space has the degree of filling according to FIG. 1. The fuse wires (4) and the lower part of the pump pipe (5) are completely surrounded by the foamed cement.

A foaming and thermosetting cement in accordance with the invention can for instance have the following composition:

30 parts of weight of phenolic resin
3 parts of weight of hexamethylene tetramine
50 parts of weight of stone powder
3 parts of weight of talc
1 parts of weight of magnesium stearate
9 parts of weight of spirits To the total basic mixture is added 4 parts of weight of calcium fluoride.

An electric bulb made in accordance with the invention, as a result of the burning-out of the incandescent filament, generates an electric arc to a normal extent in the bulb, which causes the burning-out of the fuse wires. The secondary electric arc, which in this case often arises, locally heats the cement around the fuse wires, whereby the electronegative gas (for instance from the calcium fluoride) is generated, resulting in extremely fast extinction of the electric arc. Thus, no increase of pressure in the cap strong enough to throw the cap away from the bulb will have the time to arise.

By making use of the invention conventional bulbs of different types can be equipped with uninsulated caps and electrodes without protecting glass tubes, which in addition gives rise to considerable economic advantages.

The following table reports tests performed with electric bulbs whose caps have been filled with ordinary socket cement or foam cement as a reference to bulbs whose caps have been filled with 4% by weight of $CaF_2$ according to the invention.

Table

| | Exploding lamps 10% overvoltage | Caps with melting holes |
|---|---|---|
| 250 Reference lamps ordinary cap cement | 12 | 21 |
| 95 Reference lamps foam cement without anything added | 5 | 13 |
| 2100 Exper. lamps foam cement with 4% by weight of $CaF_2$ | 0 | 3 |

Similar tests showing the same positive effects have confirmed that $CaF_2$ can be replaced by other halogen compounds, such as $PbI_2$, NaF, $BaCl_2$, CsBr.

It is important that the grain size of the added ingredient is correctly adjusted. Generally the middle grain size should be 2–2.5μ; teflon is an exception whose middle grain size should be about 40μ.

In order to achieve the desired electric arc-extinguishing effect according to the invention, a certain minimum amount of the added ingredient is required. For $CaF_2$ this amount is about 0.5% by weight. On the other hand the upper limit is determined by the modifying effect of the added amount upon the other general properties of the cement, for instance strength, foaming and simplicity to apply. The proportion of the metal halide which is added to the cement is preferably 2–4% by weight of the cement. A proportion of 3–4% by weight has proved to give a universally favourable result for metal halides and has been tested in detail for the compounds mentioned above. Teflon powder has a more limited range, and in order to get a satisfactory function the proportion should be between 0 and 1% by weight, e.g., 0.1–0.5% by weight, preferably 0.2–0.3% by weight.

What is claimed is:

1. In an improved electric lamp comprising a transparent bulb sealed in a terminal socket cap with a foamed cap cement which substantially fills the interior of said terminal cap, said terminal cap having two external contacts and contact wires descending from said bulb through said foamed cap cement in electric contact with respective of said external contacts, the improvement comprising said foamed cap cement containing in admixture therewith a halogen-containing compound selected from the group consisting of (i) metal halides in an amount between about 2 and 4% by weight of said cement, and (ii) polytetrafluoroethylene in an amount up to 1% by weight of said cement, sufficient to extinguish an electric arc that may be generated within said socket cap.

2. The electric lamp of claim 8 wherein said polytetrafluoroethylene is in the form of powder having a grain size of about 40 microns.

3. The lamp of claim 1, wherein said halogen-containing compound is said polytetrafluoroethylene.

4. The lamp of claim 1, wherein said halogen-containing compound is at least one metal halide selected from the group consisting of $CaF_2$, NaF, $PbI_2$, CsBr and $BaCl_2$, said metal halides being in the form of powder particles having a median grain size of between about 2 and 2.5 microns.

5. The lamp of claim 4, wherein said metal halide is $CaF_2$.

6. The lamp of claim 1, wherein said halogen-containing compound is $CaF_2$.

7. The lamp of claim 5, wherein said foamed cap cement comprises a phenolic resin containing an inorganic filler.

8. The lamp of claim 1, wherein said halogen-containing compound is a polytetrafluoroethylene in an amount between about 0.1% and 0.5% by weight.

9. The lamp of claim 8, wherein said polytetrafluoroethylene is in an amount between about 0.2% and 0.3% by weight of said foamed cap cement and said polytetrafluoroethylene is in the form of powder having a median grain size of about 40 microns.

10. The lamp of claim 9, wherein said foamed cap cement comprises a phenolic resin containing an inorganic filler.

11. The lamp of claim 1, wherein said foamed cap cement comprises a phenolic resin containing an inorganic filler.

* * * * *